US011367427B1

(12) United States Patent
Chang et al.

(10) Patent No.: US 11,367,427 B1
(45) Date of Patent: Jun. 21, 2022

(54) METHOD FOR FEEDFORWARD ACTIVE NOISE CONTROL SYSTEM

(71) Applicant: Chung Yuan Christian University, Taoyuan (TW)

(72) Inventors: Cheng-Yuan Chang, Taoyuan (TW); Sen-Maw Kuo, Taoyuan (TW); Chong-Rui Huang, Taoyuan (TW)

(73) Assignee: Chung Yuan Christian University, Taoyuan (TW)

( * ) Notice: Subject to any disclaimer, the term of this patent is extended or adjusted under 35 U.S.C. 154(b) by 0 days.

(21) Appl. No.: 17/313,118

(22) Filed: May 6, 2021

(30) Foreign Application Priority Data

Feb. 24, 2021 (TW) ..... 110106484

(51) Int. Cl.
*G10K 11/178* (2006.01)

(52) U.S. Cl.
CPC .. *G10K 11/17854* (2018.01); *G10K 11/17873* (2018.01); *G10K 2210/3012* (2013.01); *G10K 2210/3027* (2013.01)

(58) Field of Classification Search
CPC ..... G10K 11/17854; G10K 11/17873; G10K 2210/3012; G10K 11/17879; G10K 2210/3027
USPC ..... 381/71.11, 71.8
See application file for complete search history.

(56) References Cited

U.S. PATENT DOCUMENTS

| | | | | |
|---|---|---|---|---|
| 10,171,907 | B1 * | 1/2019 | Chang | G10K 11/1781 |
| 2005/0175187 | A1 * | 8/2005 | Wright | G10K 11/17854 381/71.12 |
| 2011/0142247 | A1 * | 6/2011 | Fellers | G10K 11/17875 381/71.1 |

* cited by examiner

*Primary Examiner* — Vivian C Chin
*Assistant Examiner* — Douglas J Suthers

(57) ABSTRACT

A design method for feedforward active noise control system is disclosed. Based on a target signal and a reference signal, a first adaptive system identifying unit is enabled to complete a first system identification process for producing a first adaptive filter, and then a second adaptive system identifying unit is enabled to complete a second system identification process for producing a second adaptive filter. After the second adaptive filter is converted to a digitally-controlled filter by using a system identification tool, the digitally-controlled filter is implemented into a DSP chip of a feedforward active noise control system. As a result, it is able to find that not only the computing loading of the DSP chip is significantly lowered while an adaptive algorithm executes an active noise control computing, but also the feedforward active noise control system exhibits a broad frequency bandwidth noise cancelling ability.

10 Claims, 7 Drawing Sheets

METHOD FOR FEEDFORWARD ACTIVE NOISE CONTROL SYSTEM

BACKGROUND OF THE INVENTION

1. Field of the Invention

The present invention relates to the technology field of environment noise attenuating, and more particularly to a design method for feedforward active noise control system.

2. Description of the Prior Art

The development of technology along with the advancement in science helps to bring in fast industrial manufacture, having good transport facilities and high tech electronic products, but also leads noise pollution to blanket the living environment. It should be known that, sound (noise) is measured in a unit called decibel (dB) or A-weighted decibels (dBA). For example, sound produced by an ordinary conversation is about 60 dBA. On the other hand, by using a decibel meter, it is able to know that the fridge noise and the air conditioner sound level are both around 60 dBA. Moreover, noises make by car horns, railway train, police sirens and take-off of airplanes are measured in a range between 100 dBA and 130 dBA. Not only that, there are also noise pollution blanketing the rural environment, including noise of leaf blower operation (~110 dBA), noise of grain dryer operation (82-102 dBA) and noise of manure spreader operation (90-105 dBA).

From above descriptions, it is understood that, how to effectively attenuate environmental noises have now become an important issue. Currently, passive noise control (PNC) and active noise control (ANC) are two principal noise attenuating ways, and the ANC technique has been widely applied in noise attenuation because of the good development of adaptive signal processing techniques and digital signal processors (DSPs). For example, Hyundai motor company utilizes the ANC technique to attenuate engine noise, and Noctua (company) applies the ANC technique in noise attenuation of radiator fan.

FIG. 1 illustrates a framework diagram of a conventional ANC system. The conventional ANC system 1' comprises: a reference microphone 1RM' for collecting a noise signal, two pre-amplifier units 13', two antialiasing filter units 14', a DSP chip 1DP', a reconstruction filter unit 11', a power amplifier 12', a loudspeaker 1LS', and an error microphone 1EM'. In which, the DSP chip 1DP' is provided with an adaptive filter and an adaptive algorithm for updating the adaptive filter therein. By such arrangement, after the reference microphone 1RM' transmits a reference signal to the DSP chip 1DP', the DSP chip 1DP' achieves an active noise control (ANC) computing base on the reference signal and an error signal, and then produces and transmits an output signal to the loudspeaker 1LS'. Consequently, the loudspeaker 1LS' broadcasts an anti-noise audio to a predetermined quiet zone according to the output signal. On the other hand, the error microphone 1EM' is adopted for collecting a residual noise signal in the quiet zone so as to transmit the error signal to the DSP chip 1DP'. Therefore, the DSP chips 1DP' utilizes the adaptive algorithm to complete the ANC computing based on a preciously-produced output signal and the error signal, and then updates the adaptive filter based on the computing result.

During a normal operation of the ANC system 1', however, the causality constraint will be violated in case of the acoustic/electric delays in the ANC system 1' exceeding the acoustic delay of the primary path. As a result, the noise attenuating performance of the ANC system 1' dramatically degrades as the degree of noncausality increases. Thus, the positions of the noise source, the reference microphone 1RM' and the error microphone 1EM' are critical when designing and manufacturing the ANC system 1' in order to improve the noise attenuating performance.

As explained in more detail below, the primary path starts at the position of the reference microphone 1RM' and ends at the position of the error microphone 1EM'. On the other hand, ANC technique follows the principle of the destructive wave interference, reducing an unwanted acoustic noise generated by a primary source through an anti-noise produced by a secondary source. The secondary path is composed by the transfer functions of the error microphone 1EM', the pre-amplifier 13', the anti-aliasing filter 14', the analog-to-digital converter (ADC) in the DSP chip 1DP', the digital-to-analog converter (DAC) in the DSP chip 1DP', the reconstruction filter 11', the power amplifier 12', the loudspeaker 1LS', and the acoustic path from loudspeaker 1LS' to error microphone 1EM'. Therefore, computing the secondary path's transfer function (i.e., S(z)) lead the computing loading of the DSP chip 1DP' to become heavy. As a result, not only the DSP chip 1DP' needs spending even more time to achieve the convergence of the ANC computing, but also the adaptive filter is updated to be a high-order filter. However, heavy computing loading of the adaptive algorithm would enlarge the electronic delay in case of the design of the ANC system is in consideration of the causality constraint of the acoustic delay of the primary path and the electronic delay of the secondary path.

From above descriptions, it is understood that there are rooms for improvement in the conventional ANC system 1'. In view of that, inventors of the present application have made great efforts to make inventive research and eventually provided a design method for feedforward active noise control system.

SUMMARY OF THE INVENTION

The primary objective of the present invention is to disclose a design method for feedforward active noise control system. In which, two noise collecting systems are adopted for collecting a real environmental noise so as to generate a first reference signal, a target signal and a second reference signal. Subsequently, based on the target signal and the second reference signal, a first adaptive system identifying unit is enabled to complete a first system identification process for producing a first adaptive filter, and then a second adaptive system identifying unit is enabled to complete a second system identification process for producing a second adaptive filter. Consequently, after the second adaptive filter is converted to a low-order digitally-controlled filter by using a system identification tool, the digitally-controlled filter is implemented into a DSP chip of a feedforward active noise control system. Thus, after the digitally-controlled filter is implemented into the DSP chip, it is able to find that not only the computing loading of the DSP chip is significantly lowered while an adaptive algorithm executes an active noise control computing, but also the feedforward active noise control system exhibits a broad frequency bandwidth noise cancelling ability.

In order to achieve the primary objective of the present invention, inventors of the present invention provides an embodiment of the design method for feedforward active noise control system, comprising following steps:

(1) recording a real environmental noise;

(2) establishing a first noise collecting system to collect a real environmental noise, thereby generating a first reference signal and a target signal;

(3) letting the first noise collecting system transmits the first reference signal and the target signal to a first system identifying unit having one first adaptive filter, and then enabling the first system identifying unit to complete an adaptive system identification of the first adaptive filter;

(4) establishing a second noise collecting system to collect the real environmental noise, thereby generating a second reference signal and the target signal;

(5) letting the first noise collecting system transmits the second reference signal and the target signal to a second system identifying unit having the at least one first adaptive filter and a second adaptive filter, and then enabling the second system identifying unit to complete an adaptive system identification of the second adaptive filter;

(6) converting the second adaptive filter to a low-order digitally-controlled filter by using a system identification tool; and (7) establishing a feedforward active noise control system, comprising: a digital signal processor (DSP) unit, a first analog-to-digital (A/D) converter coupled to the DSP unit, a first microphone coupled to the first A/D converter, a digital-to-analog (D/A) converter coupled to the DSP unit, a loudspeaker coupled to the D/A converter, a second analog-to-digital (A/D) converter coupled to the DSP unit, and a second microphone coupled to the second A/D converter, wherein the DSP unit is provided with the low-order digitally-controlled filter therein.

In one embodiment, the second noise collecting system comprises:

a noise source for broadcasting the real environmental noise by a form of audio signal;

a first audio collecting device, being disposed at a position so as to face a non-audio broadcasting side of an audio broadcasting device, thereby collecting the audio signal of the real environmental noise; wherein the non-audio broadcasting side of the audio broadcasting device faces a quiet zone;

a first pre-amplifier, being coupled to the first audio collecting device, and being used for applying a signal pre-amplifying process to the audio signal of the real environmental noise;

a second audio collecting device, being disposed at a center position of the quiet zone, so as to collect a first audio signal in the quiet zone;

a second pre-amplifier, being coupled to the second audio collecting device, and being used for applying a signal pre-amplifying process to the first audio signal;

a first A/D conversion circuit, being coupled to the first pre-amplifier for converting the audio signal of the real environmental noise to the second reference signal; and a second A/D conversion circuit, being coupled to the second pre-amplifier for converting the first audio signal to the target signal.

In one embodiment, the first noise collecting system also comprises one noise source, one second pre-amplifier, a first A/D conversion circuit, and a second A/D conversion circuit, and further comprises:

a digital signal processor, being coupled to the noise source and the audio broadcasting device, and being configured for applying a signal process to the audio signal of the real environmental noise, so as to generate and transmit a second audio signal to the audio broadcasting device, such that the audio broadcasting device broadcasts the second audio signal to the quiet zone.

In one embodiment, the first system identifying unit comprises:

the forgoing first adaptive filter, receiving the first reference signal;

a first daptive algorithm unit, being coupled to the first adaptive filter; and a first digital subtracter, being coupled to the first adaptive algorithm unit and the first adaptive filter;

wherein the first adaptive filter produces a first output signal based on the first reference signal, and the first digital subtracter applying a subtraction operation to the first output signal and the target signal so as to produce a first error signal;

wherein the first adaptive algorithm unit adaptively modulates at least one filter parameter of the first adaptive filter according to the first reference signal and the first error signal, thereby making the first error signal approach zero.

In one embodiment, the second system identifying unit comprises:

the forgoing second adaptive filter, receiving the second reference signal, and being used for generating a second output signal;

two of the forgoing first adaptive filters, wherein one of the two first adaptive filters is coupled to the second adaptive filter for receiving the second output signal so as to generate a third output signal, and the other one first adaptive filters being coupled to the second reference signal so as to generate a third reference signal;

a second digital subtracter, being coupled to the target signal and the third output signal; and a second adaptive algorithm unit, being coupled to the second adaptive filter, the two first adaptive filters, and the second digital subtracter;

wherein the second digital subtracter applies a subtraction operation to the third output signal and the target signal, so as to produce and transmit a second error signal to the second adaptive algorithm unit;

wherein the second adaptive algorithm unit adaptively modulates at least one filter parameter of the second adaptive filter according to the third reference signal and the second error signal, thereby making the second error signal approach zero.

In one embodiment, the system identification tool is a mathematical program, and the mathematical program is C programming language.

In one embodiment, the first adaptive filter and the second adaptive filter are both selected from the group consisting of finite impulse response (FIR) filter and infinite impulse response (IIR) filter, and the low-order digitally-controlled filter is an infinite impulse response (IIR) filter.

BRIEF DESCRIPTION OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE PREFERRED EMBODIMENTS

To more clearly describe a design method for feedforward active noise control system disclosed by the present invention, embodiments of the present invention will be described in detail with reference to the attached drawings hereinafter.

The present invention discloses a design method for feedforward active noise control system. In which, two noise collecting systems are adopted for collecting a real environmental noise so as to generate a first reference signal, a target signal and a second reference signal. Subsequently, based on the target signal and the second reference signal, a first adaptive system identifying unit is enabled to complete a first system identification process for producing a first adaptive filter $\hat{S}(z)$, and then a second adaptive system identifying unit is enabled to complete a second system identification process for producing a second adaptive filter W'(z). Consequently, after the second adaptive filter W'(z) is converted to a low-order digitally-controlled filter W(z) by using a system identification tool, the digitally-controlled filter W(z) is implemented into a DSP chip of a feedforward active noise control system. Thus, after the digitally-controlled filter W(z) is implemented into the DSP chip, it is able to find that not only the computing loading of the DSP chip is significantly lowered while an adaptive algorithm executes an active noise control computing, but also the feedforward active noise control system exhibits a broad frequency bandwidth noise cancelling ability.

Figure 1:
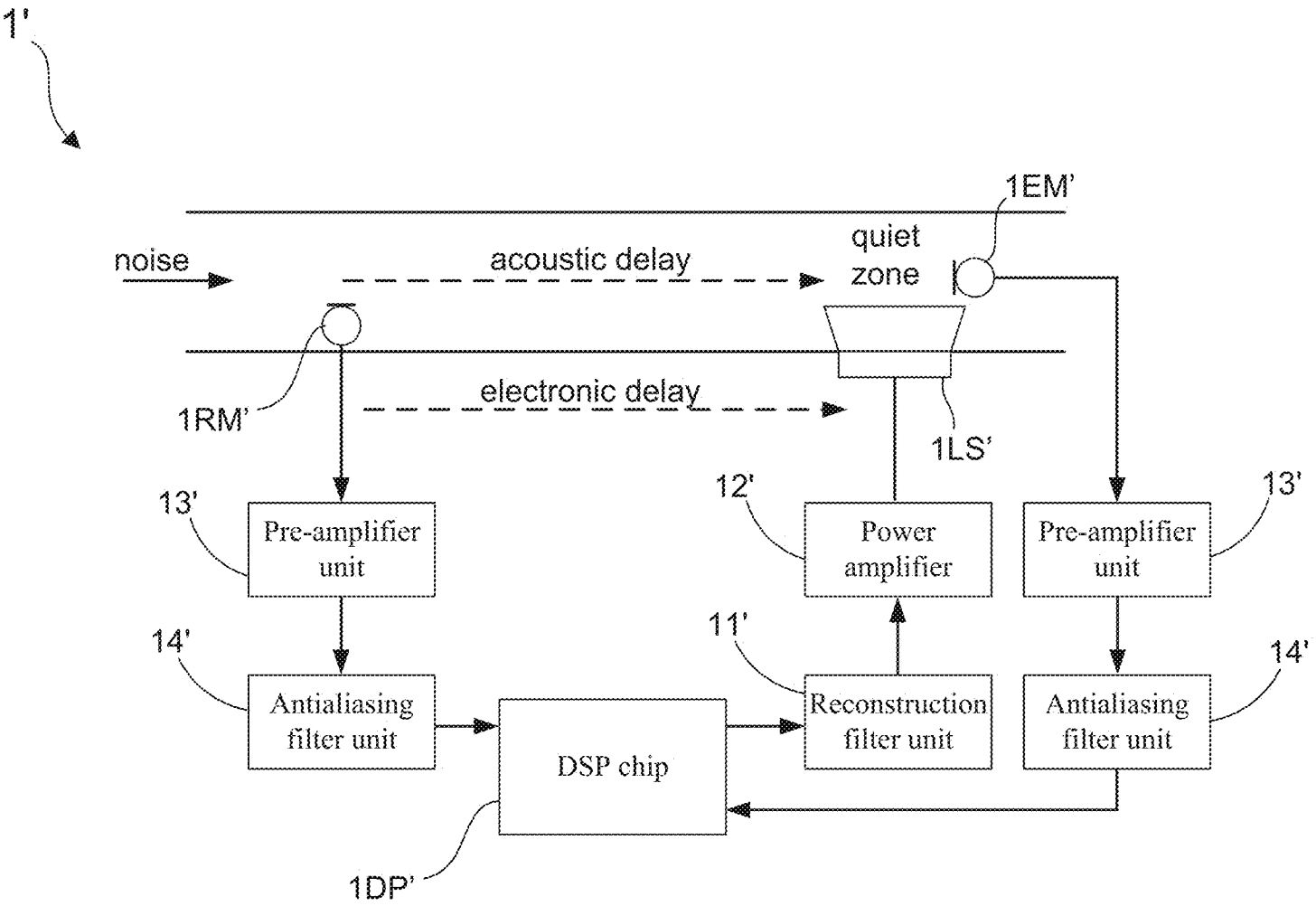
FIG. 1 (Prior art)
FIG. 1 shows a framework diagram of a conventional ANC system.
Figure 2:
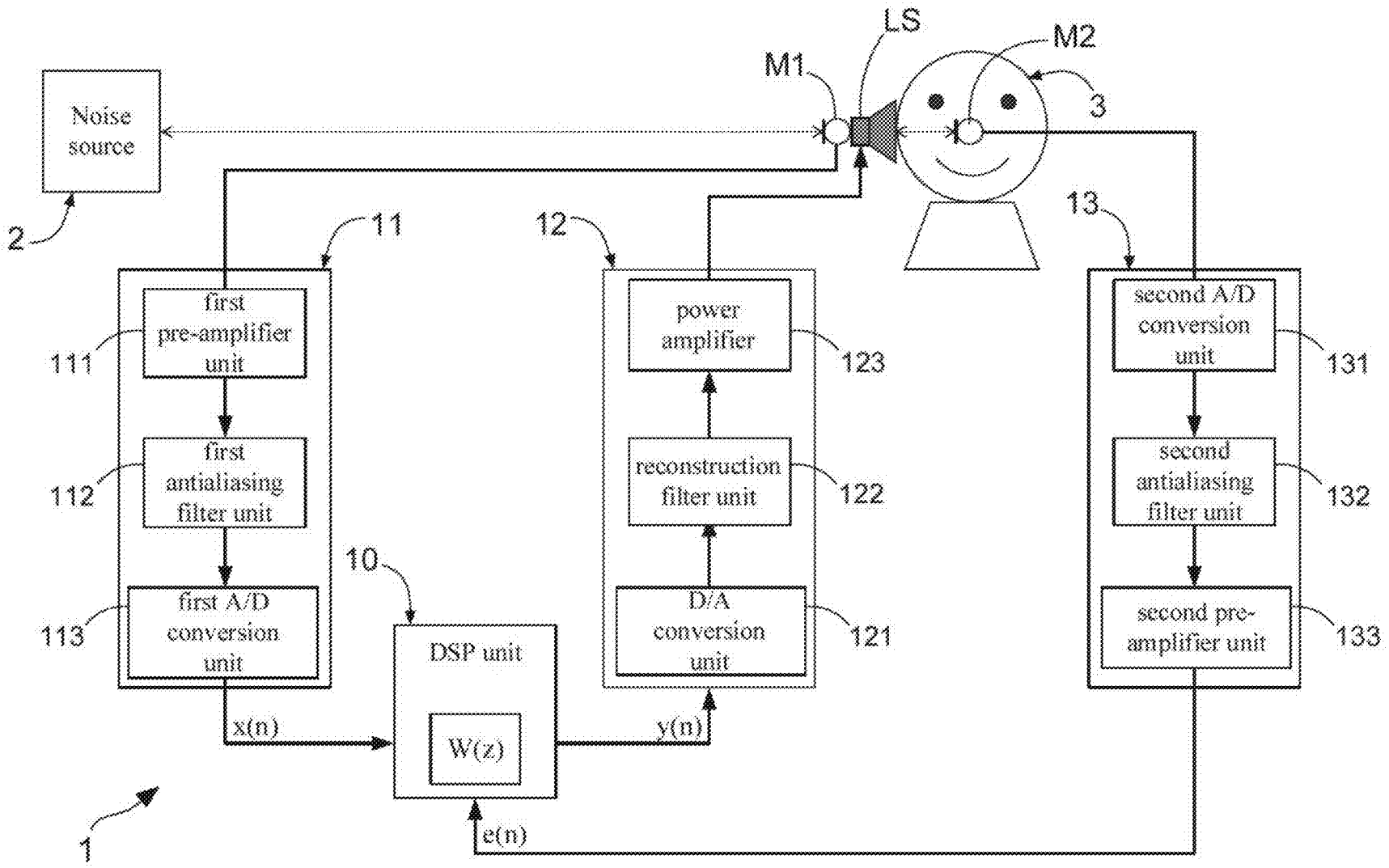
FIG. 2 shows a block diagram of a feedforward active noise control system that is established by using a design method for feedforward active noise control system according to the present invention.

FIG. 2 illustrates a block diagram of a feedforward active noise control system that is established by using the design method of the present invention. As FIG. 2 shows, the feedforward active noise control system 1 comprises a digital signal processor (DSP) unit 10, a first analog-to-digital (A/D) converter 11 coupled to the DSP unit 10, a first microphone M1 coupled to the first A/D converter 11, a digital-to-analog (D/A) converter 12 coupled to the DSP unit 10, a loudspeaker LS coupled to the D/A converter 12, a second analog-to-digital (A/D) converter 13 coupled to the DSP unit 10, and a second microphone M2 coupled to the second A/D converter 13, wherein the DSP unit 10 is provided with the low-order digitally-controlled filter W(z) therein.

Engineers skilled in development and manufacture of active noise control (ANC) systems certainly know that, the ANC system is commonly designed to form a quiet zone by taking the error microphone as a center of the quiet zone. Therefore, for an earbud that integrated with one ANC system, to form a quiet zone in an inner ear of a user makes the earbud exhibit the best noise attenuating effect. In fact, however, it is impossible to let the earbud has an error microphone disposed in the inner ear of the user. For above reason, the present invention discloses a design method for feedforward active noise control system, which utilizes virtual sensing technique to transfer the quiet zone from the center of the error microphone to the inner ear of the user.

FIG. 2 depicts that there is a digitally-controlled filter W(z) provided in the DSP unit 10, and the development of the digitally-controlled filter W(z) will be clearly introduced in following paragraphs. Moreover, FIG. 2 also depicts that the first A/D converter 11 comprises a first pre-amplifier unit 111, a first antialiasing filter unit 112 and a first A/D conversion unit 113, and the second A/D converter 13 comprises a second pre-amplifier unit 131, a second antialiasing filter unit 132 and a second A/D conversion unit 133. On the other hand, the D/A converter 12 comprises a D/A conversion unit 121, a reconstruction filter unit 122 and a power amplifier 123.

Figure 3A:
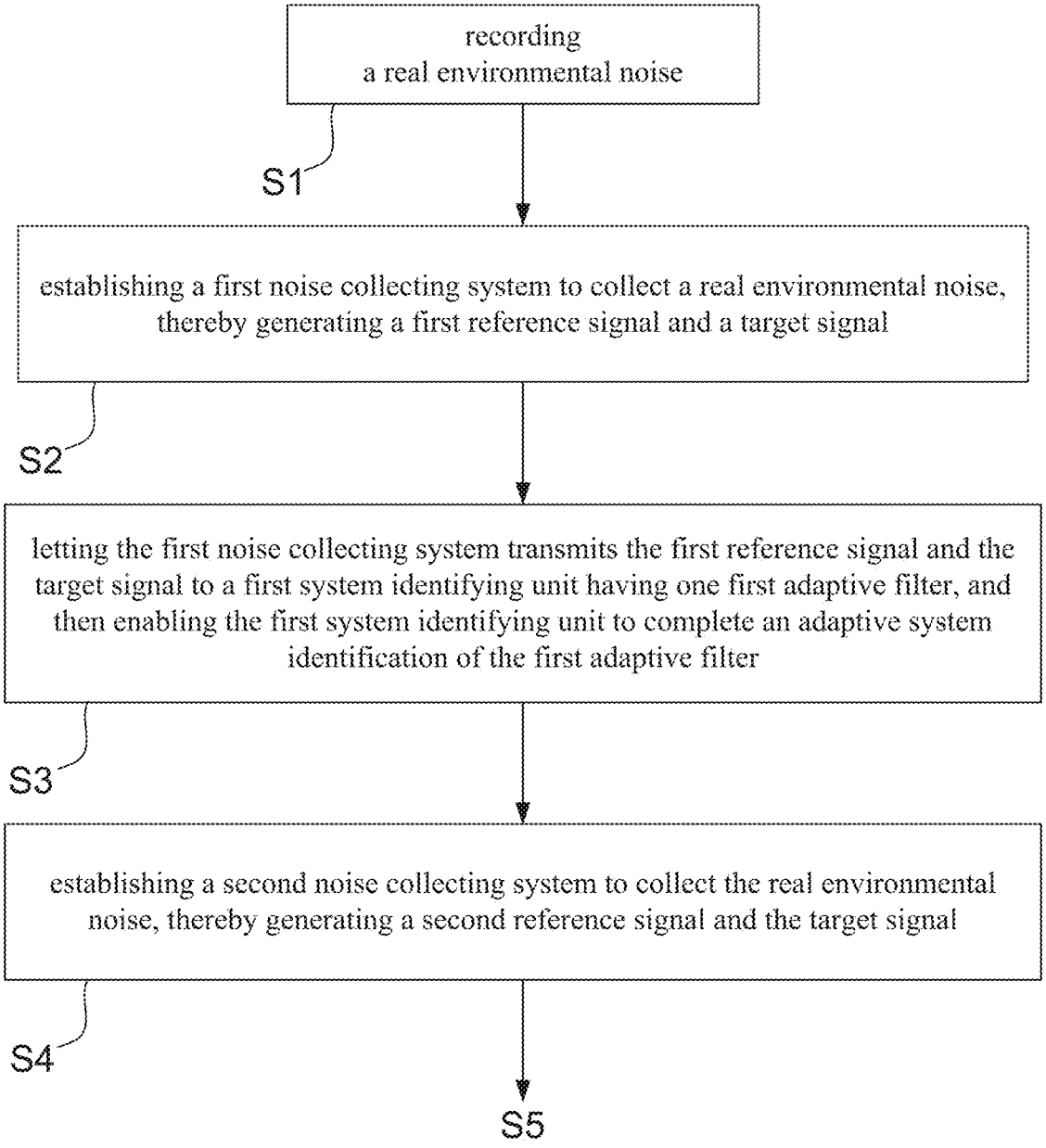
FIG. 3A and FIG. 3B show flowchart diagrams of a design method for feedforward active noise control system according to the present invention.
Figure 3B:
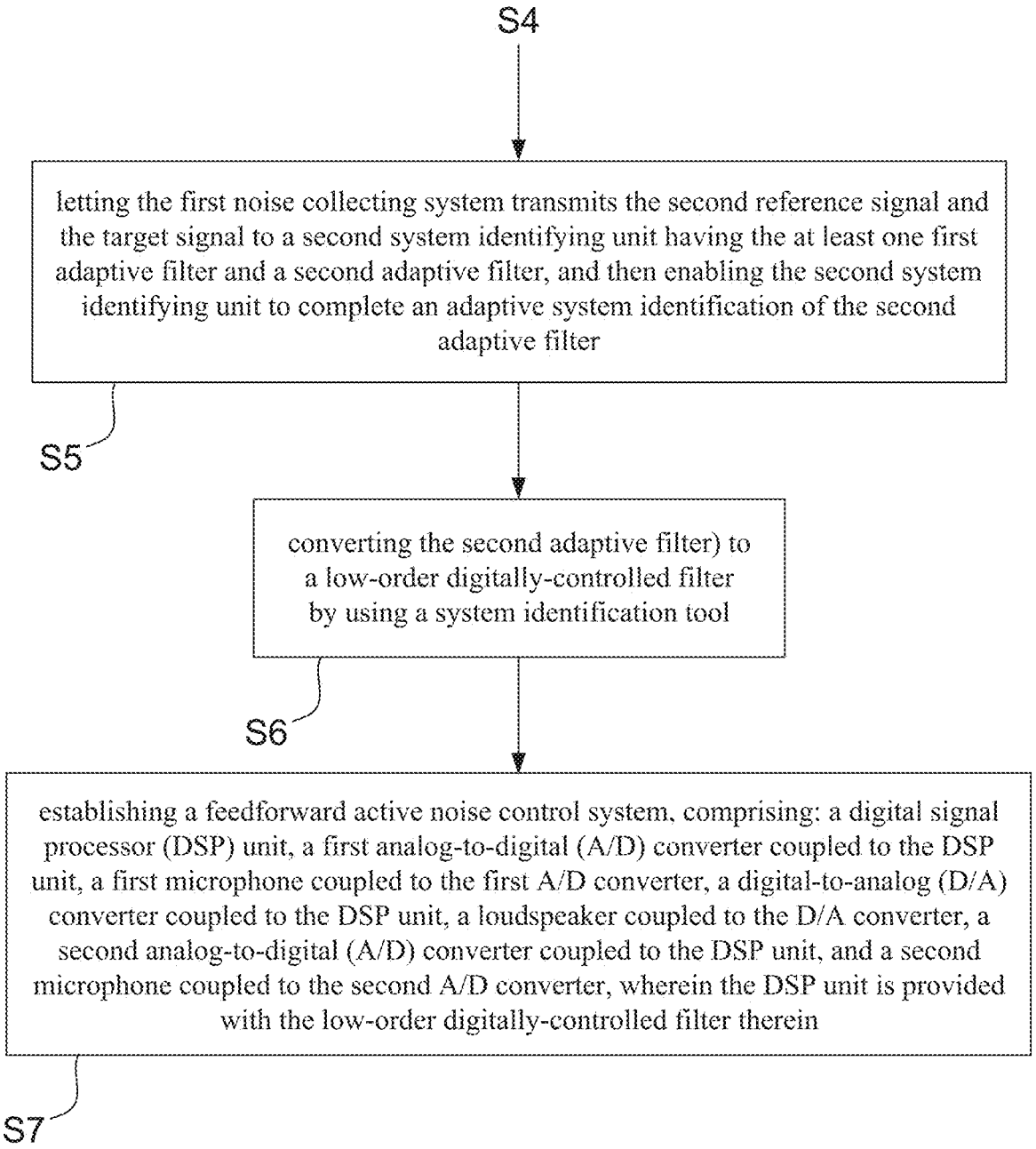

FIG. 3A and FIG. 3B show flowchart diagrams of a design method for feedforward active noise control system according to the present invention. The method flow is firstly proceeded to step S1: recording a real environmental noise.

Figure 4:
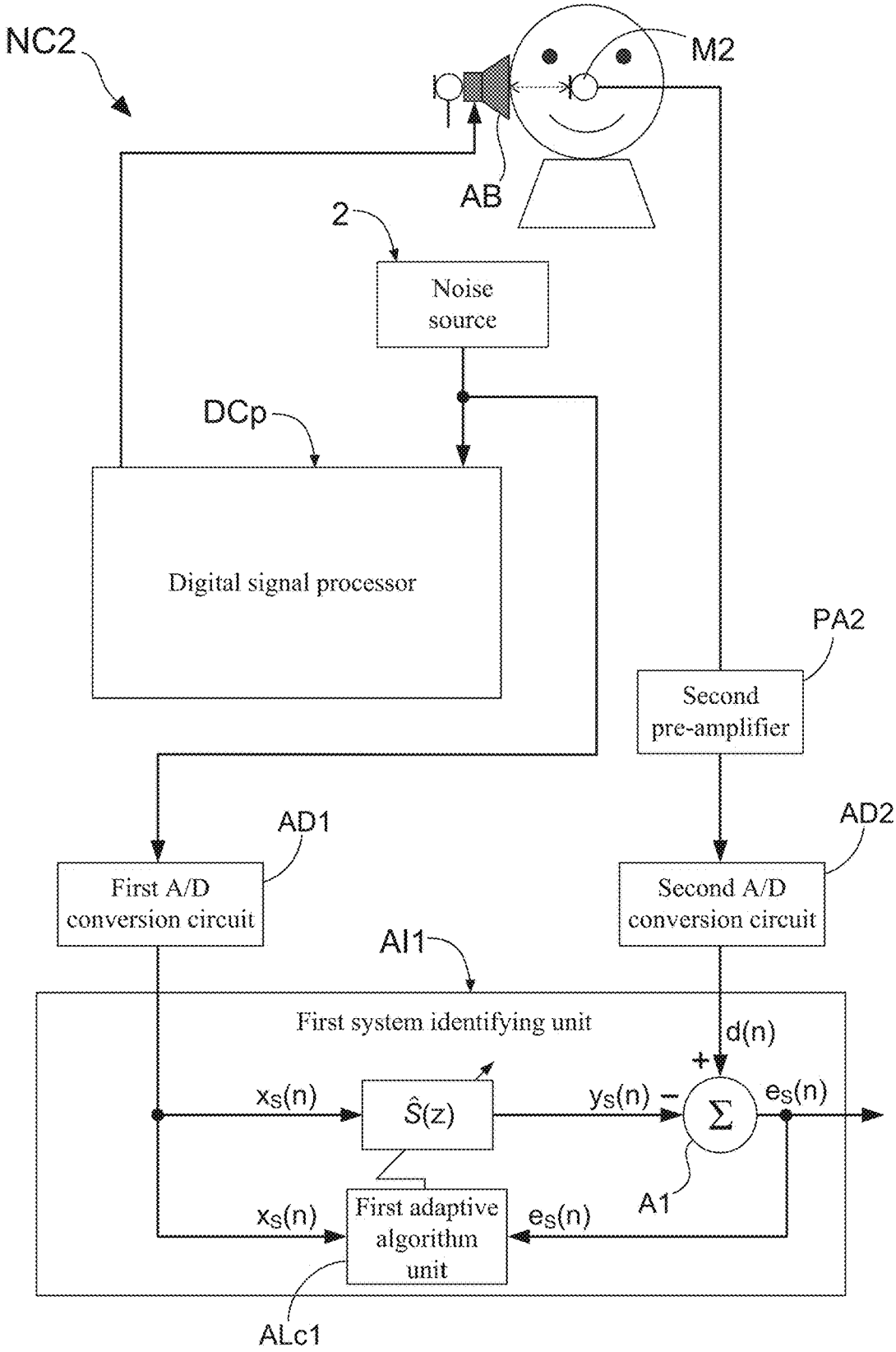
FIG. 4 shows a block diagram of a first noise collecting system.

Subsequently, step S2 is executed so as to establish a first noise collecting system NC2 to collect a real environmental noise, thereby generating a first reference signal and a target signal. FIG. 4 illustrates a block diagram of the first noise collecting system NC2. In this design method, the first noise collecting system NC2 is developed for acquiring a first reference signal x(n) and a target signal d(n) that are transmitted in the secondary path S(z). FIG. 4 depicts that the second noise collecting system NC2 also comprises a noise source 2, a second pre-amplifier AP2, a first A/D conversion circuit AD1, and a second A/D conversion circuit AD2, and further comprises a digital signal processor DCp coupled to the noise source 2 and an audio broadcasting device AB. Moreover, the digital signal processor DCp is configured for applying a signal process to the audio signal of the real environmental noise, so as to generate and transmit a second audio signal to the audio broadcasting device AB, such that the audio broadcasting device AB broadcasts the second audio signal to the quiet zone.

As described in more detail below, the digital signal processor DCp is provided with a A/D converter, a DSP unit, and a D/A converter therein, wherein the A/D converter is coupled to the noise source 2, and the D/A converter is coupled to the audio broadcasting device AB. Moreover, in the second noise collecting system NC2, the first A/D conversion circuit AD1 is coupled to the noise source 2, and is configured for converting the audio signal of the real environmental noise to a first reference signal $x_S(n)$. On the other hand, the second A/D conversion circuit AD2 is coupled to the second pre-amplifier PA2, and is configured for converting the first audio signal to a target signal d(n).

Subsequently, the method flow proceeds to step S3, so as to let the first noise collecting system NC2 transmits the first reference signal $x_S(n)$ and the target signal d(n) to a first system identifying unit AI1 having one first adaptive filter $\hat{S}(z)$, and then enabling the first system identifying unit AI1 to complete an adaptive system identification of the first adaptive filter $\hat{S}(z)$. As FIG. 4 shows, the first system identifying unit AI1 comprises: a first adaptive filter $\hat{S}(z)$, a first adaptive algorithm unit ALc1, and a first digital subtracter A1. In which, the first adaptive filter $\hat{S}(z)$ is coupled to the first A/D conversion circuit AD1, so as to receive the first reference signal $x_S(n)$. Moreover, the first adaptive algorithm unit ALc1 is coupled to the first adaptive filter $\hat{S}(z)$ and the first A/D conversion circuit AD1, and the first digital subtracter A1 is coupled to the second A/D conversion circuit AD2, the first adaptive algorithm unit ALc1 and the first adaptive filter $\hat{S}(z)$.

During the normal operation of the first system identifying unit AI1, the first adaptive filter $\hat{S}(z)$ produces a first output signal $y_S(n)$ based on the first reference signal $x_S(n)$, and the first digital subtracter A1 subsequently applies a subtraction operation to the first output signal $y_S(n)$ and the target signal d(n) so as to produce a first error signal $e_S(n)$. Thus, first adaptive algorithm unit ALc1 adaptively modulates at least one filter parameter of the first adaptive filter $\hat{S}(z)$ according to the first reference signal $x_S(n)$ and the first error signal $e_S(n)$, thereby making the first error signal $e_S(n)$ approach zero. In a practicable embodiment, the first adaptive algorithm unit ALc1 is an algorithm, such as least mean square (LMS) algorithm, normalized least mean square (NLMS) algorithm or Filtered-x LMS algorithm. Of course, the first adaptive algorithm unit ALc1 provided in the first system identifying unit AI1 is not limited to be the forgoing LMS, NLMS or Filtered-x LMS. In other words, engineers skilled in development and manufacture of ANC system should know that, there are many other mathematical algorithms suitable for being used as the first adaptive algorithm unit ALc1. On the other hand, the first adaptive filter $\hat{S}(z)$ can be a finite impulse response (FIR) filter or an infinite impulse response (IIR) filter.

For example, when using LMS algorithm as the first adaptive algorithm unit ALc1 so as to be provided in the first system identifying unit AI1, it utilizes following mathematical formulas to complete the adaptive system identification of the first adaptive filter $\hat{S}(z)$:

$$y_S(n) = \sum_{l=0}^{L-1} \hat{S}_l(n) \cdot x_S(n-1); \tag{I}$$

$$e_S(n) = d(n) - y_S(n); \text{ and} \tag{II}$$

$$\hat{S}_l(n+1) = \hat{S}_l(n) + \mu x_S(n-1) e_S(n). \tag{III}$$

In the above-listed mathematical formulas, $y_S(n)$ is the first output signal, d(n) is the target signal, $x_S(n)$ is the first reference signal, $e_S(n)$ is the first error signal, $\hat{S}_l(n)$ is a weight vector, μ is a step size of the first adaptive filter $\hat{S}(z)$, and L is a filter length of the first adaptive filter $\hat{S}(z)$. It is understood that, the first system identifying unit AI1 is adapted for completing an adaptive system identification of the first adaptive filter $\hat{S}(z)$. During the execution of the adaptive system identification, the first adaptive algorithm unit ALc1 adaptively modulates at least one filter parameter of the first adaptive filter $\hat{S}(z)$ according to the first reference signal $x_S(n)$ and the first error signal $e_S(n)$, thereby making the first error signal $e_S(n)$ approach zero. After the adaptive system identification of the first adaptive filter $\hat{S}(z)$ is completed, an estimated transfer function of the secondary path S(z) is acquired (i.e., the first adaptive filter $\hat{S}(z)$).

Figure 5:
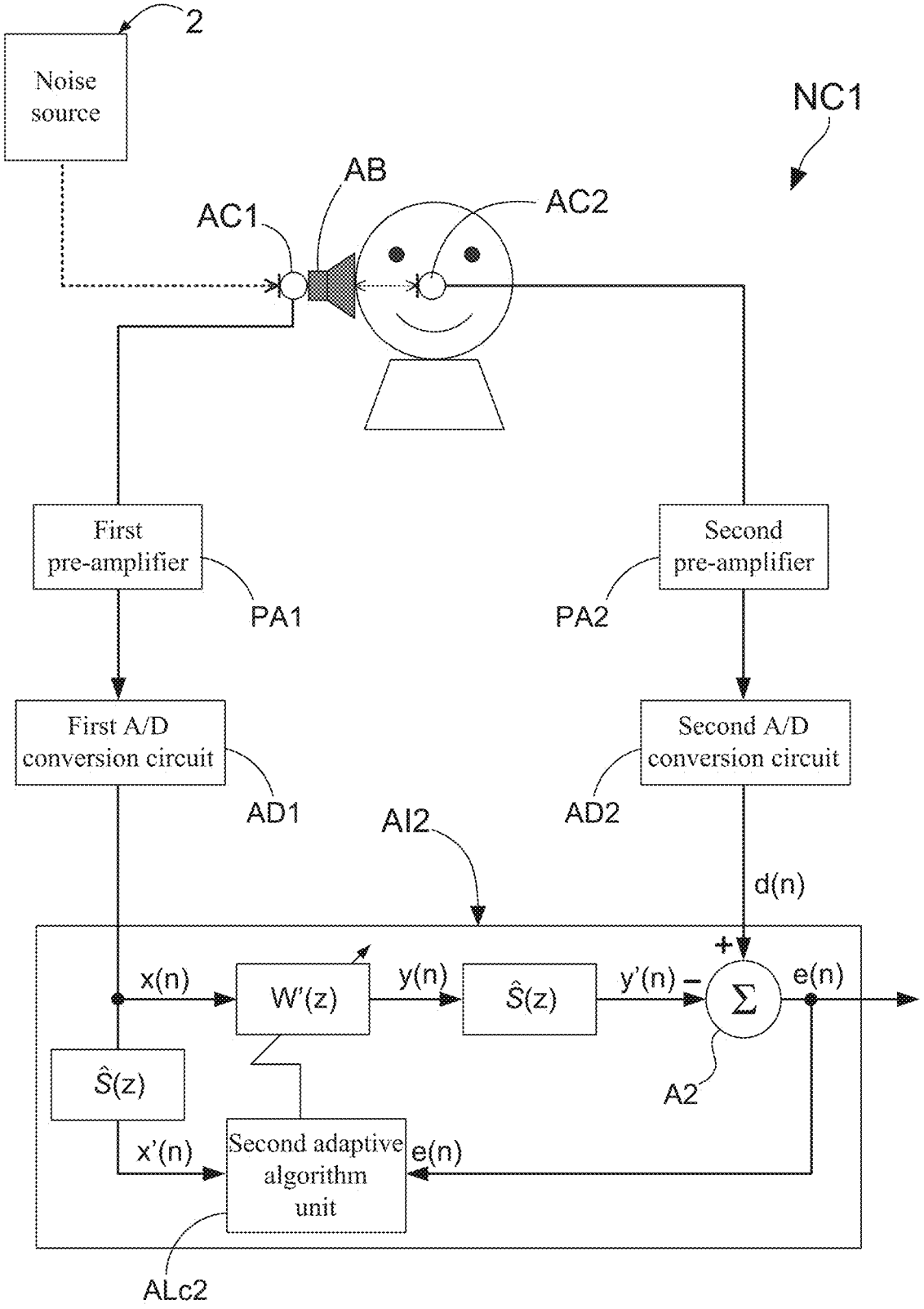
FIG. 5 shows a block diagram of a second noise collecting system.

Subsequently, the method flow proceeds to step S4, so as to establish a second noise collecting system NC1 to collect the real environmental noise, thereby generating a second reference signal x(n) and the target signal d(n). FIG. 5 illustrates a block diagram of the second noise collecting system NC1. In this design method, the second noise collecting system NC1 is developed for acquiring the second reference signal x(n) and the target signal d(n) that are transmitted in the primary path P(z). FIG. 5 depicts that the second noise collecting system NC1 comprises a noise source 2 for broadcasting the real environmental noise by a form of audio signal, a first audio collecting device AC1, a first pre-amplifier AP1, a second audio collecting device AC2, and a second pre-amplifier AP2.

The first audio collecting device AC1 is disposed at a position for being faced a non-audio broadcasting side of an audio broadcasting device AB, so as to collect the audio signal of the real environmental noise. As FIG. 5 shows, the non-audio broadcasting side of the audio broadcasting device AB faces a quiet zone (i.e., right ear simulator of the KEMAR head 3). Moreover, the first pre-amplifier AP1 is coupled to the first audio collecting device AC1, and is used for applying a signal pre-amplifying process to the audio signal of the real environmental noise. On the other hand, the second audio collecting device AC2 is taken as the forgoing second microphone M2 (i.e., right ear simulator of the KEMAR head 3), such that the second audio collecting device AC2 is disposed at a center position of the quiet zone for collecting a first audio signal in the quiet zone. Moreover, the second pre-amplifier AP2 is coupled to the second audio collecting device AC2 so as to for apply a signal pre-amplifying process to the first audio signal.

As FIG. 4 shows, the first A/D conversion circuit AD1 is coupled to the first pre-amplifier PA1, and is configured for converting the audio signal of the real environmental noise to a second reference signal x(n) by a sampling rate. On the other hand, the second A/D conversion circuit AD2 is coupled to the second pre-amplifier PA2, and is configured for converting the first audio signal to a target signal d(n) by the same sampling rate.

Subsequently, method flow proceeds to step S5, letting the first noise collecting system NC2 transmits the second reference signal x(n) and the target signal d(n) to a second system identifying unit AI2 having the at least one first adaptive filter $\hat{S}(z)$ and a second adaptive filter W'(z), and then enabling the second system identifying unit AI2 to complete an adaptive system identification of the second adaptive filter W'(z). As FIG. 5 shows, the second system identifying unit AI2 comprises: a second adaptive filter W'(z), two first adaptive filters $\hat{S}(z)$, a second digital subtracter A2, and a second adaptive algorithm unit ALc2. In which, the second adaptive filter W'(z) receives the second reference signal x(n), and is used for generating a second output signal y(n). As described in more detail below, one first adaptive filters $\hat{S}(z)$ is coupled to the second adaptive filter W'(z) for receiving the second output signal y(n) so as to generate a third output signal y'(n), and the other one first adaptive filters $\hat{S}(z)$ is coupled to the second reference signal x(n) so as to generate a third reference signal x'(n). Moreover, the second digital subtracter A2 is coupled to the target signal d(n) and the third output signal y'(n), and the second adaptive algorithm unit ALc2 is coupled to the second adaptive filter W'(z), the two first adaptive filters $\hat{S}(z)$ and the second digital subtracter A2.

During the normal operation of the second system identifying unit AI2, the second digital subtracter A2 applies a subtraction operation to the third output signal y'(n) and the target signal d(n), so as to produce and transmit a second error signal e(n) to the second adaptive algorithm unit ALc2. Thus, the second adaptive algorithm unit ALc2 adaptively modulates at least one filter parameter of the second adaptive filter W'(z) according to the third reference signal x'(n) and the second error signal e(n), thereby making the second error signal e(n) approach zero.

In a practicable embodiment, the second adaptive algorithm unit ALc2 is an algorithm, such as least mean square (LMS) algorithm, normalized least mean square (NLMS) algorithm or Filtered-x LMS algorithm. Of course, the second adaptive algorithm unit ALc2 provided in the second system identifying unit AI2 is not limited to be the forgoing LMS, NLMS or Filtered-x LMS. Of course, engineers skilled in development and manufacture of ANC system certainly know that, there are many other mathematical algorithms suitable for being used as the second adaptive algorithm unit ALc2. On the other hand, the second adaptive filter W'(z) can be a finite impulse response (FIR) filter or an infinite impulse response (IIR) filter. For example, when using LMS algorithm as the second adaptive algorithm unit ALc2 so as to be provided in the second system identifying unit AI2, it utilizes following mathematical formulas to complete the adaptive system identification of the second adaptive filter W'(z):

$$y(n) = \sum_{l=0}^{L-1} w_l(n) \cdot x(n-l); \quad \text{(IV)}$$

$$e(n) = d(n) - y'(n); \quad \text{(V)}$$

$$x'(n) = \sum_{m=0}^{M-1} \hat{S}_m(n) \cdot x(n-m); \text{ and} \quad \text{(VI)}$$

$$w_l(n+1) = w_l(n) + \mu x'(n-1)e(n). \quad \text{(VI)}$$

In the above-listed mathematical formulas, y(n) is the second output signal, y'(n) is the third output signal, d(n) is the target signal, x(n) is the second reference signal, x'(n) is the third reference signal, e(n) is the second error signal, $w_l(n)$ is a weight vector, $\hat{S}_m(n)$ is a weight vector, μ is a step size of the second adaptive filter W'(z), and L and M is both a filter length. It is understood that, the second system identifying unit AI2 is adapted for completing an adaptive system identification of the second adaptive filter W'(z). After the adaptive system identification is completed, the second adaptive filter W'(z) is acquired.

Subsequently, method flow proceeds to step S6 for converting the second adaptive filter W'(z) to a low-order digitally-controlled filter W(z) by using a system identification tool. In a practicable embodiment, the system identification tool is a mathematical program, such as C programming language. Of course, engineers skilled in use of system identification tool certainly know that, there are many other programs suitable for completing the system identification; for example, Assembly.

In one embodiment, the low-order digitally-controlled filter W(z) is established by serially connecting several 2-order IIR filters, wherein each the 2-order IIR filter can be presented by following mathematical equation:

$$y(n)=[b_0x(n)+b_1x(n-1)+b_2x(n-2)]-[a_1x(n-1)+a_2x(n-2)$$

In the above-listed mathematical equation, the y(n) is the second output signal, and b0, b1, b2, a1, and a2 are filter parameters. From above descriptions, it is understood that, the design method for feedforward active noise control system firstly utilizes two noise collecting systems (NC1, NC2) to collect a real environmental noise so as to generate a first reference signal x(n), a target signal d(n) and a second reference signal $x_S(n)$. Subsequently, based on the target signal d(n) and the second reference signal $x_S(n)$, a first adaptive system identifying unit AI1 is enabled to complete a first system identification process for producing a first adaptive filter Ŝ"(z), and then a second adaptive system identifying unit AI2 is enabled to complete a second system identification process for producing a second adaptive filter W'(z). Consequently, the second adaptive filter W'(z) is converted to a low-order digitally-controlled filter W(z) by using a system identification tool like C programming language.

Figure 6:
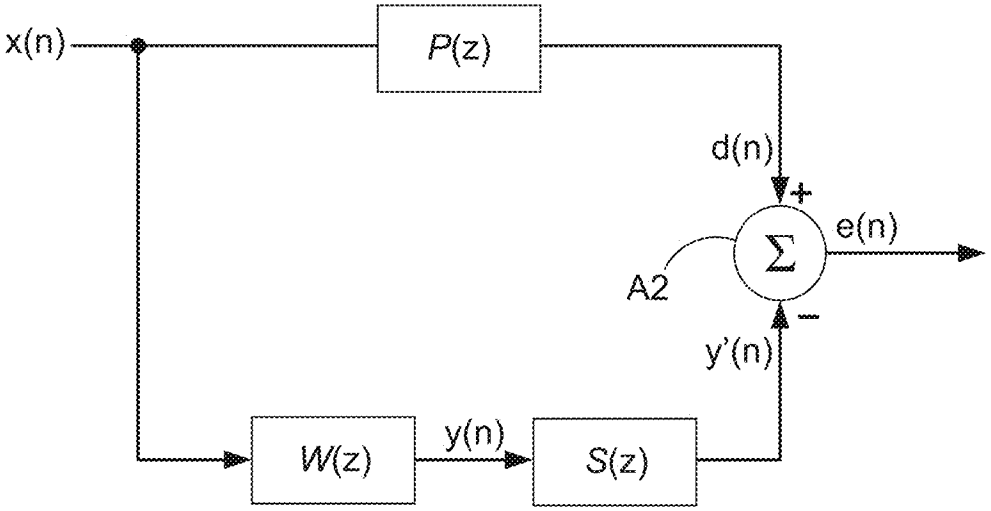
FIG. 6 shows a block diagram of a feedforward active noise control algorithm.

In a normal case, the second system identifying unit AI2 shown in FIG. 5 can be implemented into the DSP unit 10 of the feedforward active noise control system 1 that is shown in FIG. 2, so as to generate a second output signal y(n) based on a second reference signal x(n) transmitted from the first A/D converter 11 and a target signal (d) transmitted from the second A/D converter 13. However, it is worth noting that the second adaptive filter W'(z) is a FIR filter. Thus, in case of the second adaptive algorithm unit ALc2 adaptively modulate the filter parameters of the according to the third reference signal x'(n) and the second error signal e(n), the second adaptive algorithm unit ALc2 needs spending significant time to achieve the convergence of the ANC computing, such that the adaptive filter is updated to be a high-order filter. As a result, heavy computing loading of the second adaptive algorithm unit ALc2 not only enlarges the electronic delay of the feedforward active noise control system 1, but also cause the feedforward active noise control system 1 exhibit an unfavorable noise attenuating performance. For above reason, the design method of the present invention converts the second adaptive filter W'(z) to a low-order digitally-controlled filter W(z) by using a system identification tool, and then implemented the low-order digitally-controlled filter W(z) into the DSP unit 10 of the feedforward active noise control system 1. Thus, after the digitally-controlled filter W(z) is implemented into the DSP unit 10, method step S7 is completed so as to establish the feedforward active noise control system 1. As FIG. 2 shows, the feedforward active noise control system 1 includes a digital signal processor (DSP) unit 10, a first analog-to-digital (A/D) converter 11 coupled to the DSP unit 10, a first microphone M1 coupled to the first A/D converter 11, a digital-to-analog (D/A) converter 12 coupled to the DSP unit 10, a loudspeaker LS coupled to the D/A converter 12, a second analog-to-digital (A/D) converter 13 coupled to the DSP unit 10, and a second microphone M2 coupled to the second A/D converter 13, wherein the DSP unit 10 is provided with the low-order digitally-controlled filter W(z) therein. FIG. 6 shows a block diagram of the feedforward active noise control algorithm. In which, P(z) means a transfer function of the primary path, and S(z) is the transfer function of the secondary path.

The above description is made on embodiments of the present invention. However, the embodiments are not intended to limit scope of the present invention, and all equivalent implementations or alterations within the spirit of the present invention still fall within the scope of the present invention.

What is claimed is:

1. A design method for feedforward active noise control system, comprising following steps:

(1) recording a real environmental noise to generate a recorded real environmental noise;

(2) providing a first noise collecting system to generate a first reference signal and a first target signal based on the recorded real environmental noise;

(3) transmitting, by the first noise collecting system, the first reference signal and the first target signal to a first system identifying unit having one first adaptive filter, and then completing a first adaptive system identification of the first adaptive filter by the first system identifying unit;

(4) providing a second noise collecting system to generate a second reference signal and a second target signal based on the recorded real environmental noise;

(5) transmitting, by the second noise collecting system, the second reference signal and the second target signal to a second system identifying unit having the at least one first adaptive filter and a second adaptive filter, and then completing a second adaptive system identification of the second adaptive filter by the second system identifying unit;

(6) converting the second adaptive filter to a low-order digitally-controlled filter by using a system identification tool; and (7) providing a feedforward active noise control system, comprising: a digital signal processor (DSP) unit, a first analog-to-digital (A/D) converter coupled to the DSP unit, a first microphone coupled to the first A/D converter, a digital-to-analog (D/A) converter coupled to the DSP unit, a loudspeaker coupled to the D/A converter, a second analog-to-digital (A/D) converter coupled to the DSP unit, and a second microphone coupled to the second A/D converter, wherein the DSP unit is provided with the low-order digitally-controlled filter therein.

2. The design method of claim 1, wherein the second noise collecting system comprises:

a noise source for broadcasting the real environmental noise by a form of audio signal;

a first audio collecting device, being disposed at a position to face a non-audio broadcasting side of an audio broadcasting device, for collecting the audio signal of the real environmental noise;

wherein the non-audio broadcasting side of the audio broadcasting device faces a quiet zone;

a first pre-amplifier, being coupled to the first audio collecting device, and being used for applying a signal pre-amplifying process to the audio signal of the real environmental noise;

a second audio collecting device, being disposed at a center position of the quiet zone, so as to collect a first audio signal in the quiet zone;

a second pre-amplifier, being coupled to the second audio collecting device, and being used for applying a signal pre-amplifying process to the first audio signal;

a first A/D conversion circuit, being coupled to the first pre-amplifier for converting the audio signal of the real environmental noise to the second reference signal; and a second A/D conversion circuit, being coupled to the second pre-amplifier for converting the first audio signal to the second target signal.

3. The design method of claim 2, wherein the first noise collecting system also comprises one noise source, one second pre-amplifier, a first A/D conversion circuit, and a second A/D conversion circuit, and further comprises:

a digital signal processor, being coupled to the noise source and the audio broadcasting device, and being configured for applying a signal process to the audio signal of the real environmental noise, so as to generate and transmit a second audio signal to the audio broadcasting device, such that the audio broadcasting device broadcasts the second audio signal to the quiet zone.

4. The design method of claim 3, wherein the first system identifying unit comprises:

the forgoing first adaptive filter, receiving the first reference signal;

a first adaptive algorithm unit, being coupled to the first adaptive filter, and receiving the first reference signal and the first target signal; and a first digital subtracter, being coupled to the first adaptive algorithm unit and the first adaptive filter;

wherein the first adaptive filter produces a first output signal based on the first reference signal, and the first digital subtracter applying a subtraction operation to the first output signal and the first target signal so as to produce a first error signal;

wherein the first adaptive algorithm unit adaptively modulates at least one filter parameter of the first adaptive filter according to the first reference signal and the first error signal, for making the first error signal approach zero.

5. The design method of claim 4, wherein the second system identifying unit comprises:

the forgoing second adaptive filter, receiving the second reference signal, and being used for generating a second output signal;

two of the forgoing first adaptive filters, wherein one of the two first adaptive filters is coupled to the second adaptive filter for receiving the second output signal so as to generate a third output signal, and the other one first adaptive filters being coupled to the second reference signal so as to generate a third reference signal;

a second digital subtracter, being coupled to the second target signal and the third output signal; and a second adaptive algorithm unit, being coupled to the second adaptive filter, the two first adaptive filters, and the second digital subtracter;

wherein the second digital subtracter applies a subtraction operation to the third output signal and the second target signal, so as to produce and transmit a second error signal to the second adaptive algorithm unit;

wherein the second adaptive algorithm unit adaptively modulates at least one filter parameter of the second adaptive filter according to the third reference signal and the second error signal, for making the second error signal approach zero.

6. The design method of claim 5, wherein the system identification tool is a mathematical program, and the mathematical program being programmed in the C programming language.

7. The design method of claim 5, wherein the first adaptive algorithm unit and the second adaptive algorithm unit are both an algorithm that is selected from the group consisting of least mean square (LMS) algorithm, normalized least mean square (NLMS) algorithm and Filtered-x LMS algorithm.

8. The design method of claim 5, wherein the first adaptive filter and the second adaptive filter are both selected from the group consisting of finite impulse response (FIR) filter and infinite impulse response (IIR) filter, and the low-order digitally-controlled filter being an infinite impulse response (IIR) filter.

9. The design method of claim 5, wherein the first system identifying unit utilizes following mathematical formulas to complete the adaptive system identification of the first adaptive filter:

$$y_S(n) = \sum_{l=0}^{L-1} \hat{S}_l(n) \cdot x_S(n-l); \tag{I}$$

$$e_s(n)=d(n)-y_s(n); \text{ and} \tag{II}$$

$$\hat{S}_1(n+1)=\hat{S}_1(n)+\mu x_s(n-1)e_s(n); \tag{III}$$

wherein $y_S(n)$ is the first output signal, d(n) being the first target signal, $x_s(n)$ being the first reference signal, $e_s(n)$ being the first error signal, $\hat{S}_1(n)$ being a weight vector, μ being a step size of the first adaptive filter, and L being a length of the first adaptive filter.

10. The design method of claim 9, wherein the second system identifying unit utilizes following mathematical formulas to complete the adaptive system identification of the second adaptive filter:

$$y(n) = \sum_{l=0}^{L-1} w_l(n) \cdot x(n-l); \quad \text{(IV)}$$

$$e(n) = d(n) - y'(n); \quad \text{(V)}$$

$$x'(n) = \sum_{m=0}^{M-1} \hat{S}_m(n) \cdot x(n-m); \text{ and} \quad \text{(VI)}$$

$$w_l(n+1) = w_l(n) + \mu x'(n-1)e(n); \quad \text{(VII)}$$

wherein y(n) is the second output signal, y'(n) being the third output signal, d(n) being the second target signal, x(n) being the second reference signal, x'(n) being the third reference signal, e(n) being the second error signal, $w_l(n)$ being a weight vector, $\hat{S}_m(n)$ being a weight vector, μ being a step size of the second adaptive filter, and L and M being both a filter length.

* * * * *